United States Patent [19]

Leiper

[11] 4,441,773

[45] Apr. 10, 1984

[54] BOTTOM MOUNTED DRAWER SLIDE ASSEMBLY

[75] Inventor: Fred B. Leiper, Valley Cottage, N.Y.

[73] Assignee: Hardware Designers, Inc., Mt. Kisco, N.Y.

[21] Appl. No.: 346,521

[22] Filed: Feb. 8, 1982

[51] Int. Cl.[3] ..... A47B 88/00; F16C 21/00

[52] U.S. Cl. ..... 312/330 R; 312/333; 312/345; 312/348; 308/3.8

[58] Field of Search ..... 312/330 R, 333, 339, 312/340, 345, 348, 337; 308/316, 318

[56] References Cited

U.S. PATENT DOCUMENTS

| | | | |
|---|---|---|---|
| 2,587,691 | 3/1952 | Brewer | 312/348 |
| 2,850,347 | 9/1958 | Lepp | 312/345 |
| 3,033,639 | 5/1962 | Emery | 312/348 |
| 3,365,261 | 1/1968 | Gutner | 312/330 R |
| 3,649,087 | 3/1972 | Thomas | 312/345 |
| 3,658,399 | 4/1972 | Vogt | 312/333 |
| 3,797,906 | 3/1974 | Gutner | 312/330 R |
| 3,926,492 | 12/1975 | Gutner | 312/348 |
| 3,980,365 | 9/1976 | MacDonald et al. | 312/345 |
| 4,285,560 | 8/1981 | Miller | 312/348 |
| 4,305,625 | 12/1981 | Gutner et al. | 312/330 R |

*Primary Examiner*—Victor N. Sakran

*Attorney, Agent, or Firm*—Mark T. Basseches; Paula T. Basseches

[57] ABSTRACT

The present invention is directed to improvements in bottom mounted drawer slide assemblies and pertains more particularly to an assembly adapted to provide a secure connection between the drawer channel component of the assembly and drawers of a wide variety of depths.

7 Claims, 5 Drawing Figures

BOTTOM MOUNTED DRAWER SLIDE ASSEMBLY

BACKGROUND OF THE INVENTION

1. Field of the Invention

The present invention is in the field of drawer slides and more particularly in the field of bottom mounted drawer slides, i.e. drawer slides wherein a first channel section is secured in horizontal position to a cabinet and a second channel section, longitudinally movably mounted to the first mentioned channel, is fixed to the undersurface of the drawer.

2. The Prior Art

Conventional slide assemblies intended for bottom mounting comprise a pair of telescopically interconnected U-shaped channel sections having antifriction means, such as ball bearings and the like, interposed therebetween to enable relative sliding movement between the channel components. The cabinet mounted or fixed component is typically fixed in position by securing the innermost end of the channel to a bracket or like fixture, which is in turn fastened to a vertical component of the cabinet. The forward end of the cabinet channel is fastened to a horizontal component of the cabinet adjacent the front or outer end of the drawer opening.

Mounting of the cabinet channel normally presents no particular problem insofar as effecting a rigid connection of the channel to the cabinet since the shell of the cabinet is generally of substantial structural strength, thereby permitting fasteners such as screws to be securely anchored therein.

Mounting of the moving channel (hereafter the drawer channel) to the drawer presents a different and more difficult problem.

Typically, a drawer, such as a wooden drawer, is provided with substantial front, rear and side panels or walls defining a rectangular enclosure. The bottom of the drawer, however, is normally comprised of a thin sheet of fiberboard or wood, the margins of which are encompassed within a continuous groove formed on the inner faces of the walls forming the rectangular enclosure. Thus, it will be perceived that due to the relatively low structural strength of the drawer bottom a secure connection between the drawer channel and the drawer bottom cannot normally be effected. While it is possible to effect a connection, particularly at the rear of the drawer, by running a screw or like fastener upwardly from the drawer channel and into the rear panel or wall of the drawer, such practice is disadvntageous in that the screw must be anchored in the end grain of the panel which, as is known, provides at best an insecure connection. Additionally, the application of a screw or the like to the end grain of a drawer panel is likely to induce cracking of the panel.

Where drawer slides of the type described are intended for use with mass produced drawers, i.e. where the distance between the rear surface of the front panel of the drawer and the rear surface of the rear panel of the drawer, is maintained within close tolerances, it is a simple matter to provide a stock or standardized drawer channel having vertically directed, integrally fixed brackets struck from the metallic material of the channel, spacing of the brackets being coordinated with the distance between the front and rear panels in such manner that the front face of the forward bracket will lie adjacent the rear face of the front panel of the drawer when the front face of the rear bracket lies against the rear face of the rear panel of the drawer.

It will be readily recognized that a stock construction as described is not adaptable for attachment to drawers of a variety of depths.

SUMMARY OF THE INVENTION

The present invention may be summarized as directed to improvements in drawer slide assemblies and particularly to bottom mounted drawer slide assemblies having novel mounting means rendering the same adaptable for connection to drawers of a wide variety of depths.

More particularly, the mounting means of the drawer slide assembly in accordance with the invention enables a secure connection to be effected between the drawer channel and drawers whose depths are not maintained within close tolerances without resort to fastening into the end grain of the rear panel of the drawers.

The slide assembly of the invention is characterized in the provision of a drawer channel having a plurality of longitudinally displaced mounting apertures adjacent the rear end of the channel.

A mounting bracket is provided which includes an attachment finger adapted to be passed through any one of the selected mounting apertures. The bracket includes forward and rearward attachment faces which, in the mounted position of the bracket to the channel, selectively may be engaged against the rear panel of the drawer.

By providing an aperture in the bracket, a fastener such as a screw may be run into the rear panel, providing a cross grain and, consequently, a secure connection between the bracket and the rear panel, at the same time locking the bracket to the channel.

A further characterizing feature of the invention resides in offsetting the front and rear attachment surfaces of the bracket by a distance which is coordinated with the longitudinal spacing and longitudinal extent of the mounting apertures, such that even if the depth of the drawer is such as to lie between the longitudinal spacings of the mounting apertures, a firm connection may be afforded by selecting either the front or the rear attachment surface of the bracket as the surface disposed against the rear panel of the drawer.

It is accordingly an object of the invention to provide an improved bottom mounted drawer slide assembly.

It is a further object of the invention to provide a drawer slide assembly of the type described which permits a secure cross grain connection to be effected between the rear panel of the drawer and the drawer channel throughout a wide range of drawer depths.

Still a further object of the invention is the provision of an assembly of the type described wherein the desirable features aforesaid are provided without significant weakening of the structural strength of the drawer channel.

To attain these objects and such further objects as may appear herein or be hereinafter pointed out, reference is made to the accompanying drawings forming a part hereof, in which.

Figure 1:
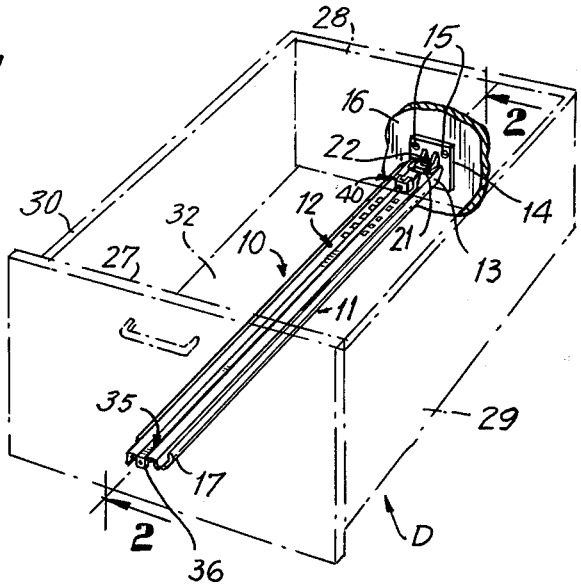
FIG. 1 is a perspective view of a drawer slide assembly in accordance with the invention, with the drawer member indicated in phantom.
Figure 2:
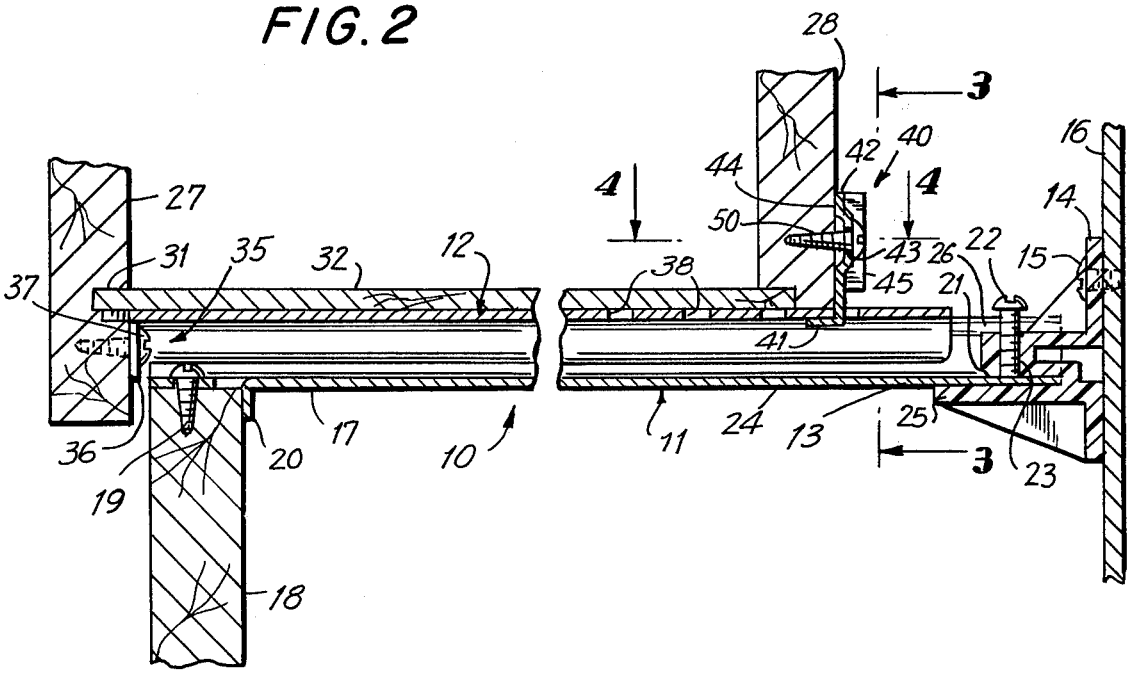
FIG. 2 is a magnified vertical section taken on the line 2—2 of FIG. 1.

Turning now to the drawings, there is shown in FIG. 1, by way of illustration, a bottom mounted drawer slide assembly, the drawer being in the closed position. The slide assembly 10 includes a cabinet mounted channel 11 and a drawer mounted channel 12.

The cabinet mounted channel 11 includes a rear end portion 13 supported on a bracket 14 made fast, as by screws 15, to a vertical wall portion 16 of the cabinet shell surrounding the drawer. The forward end 17 of the cabinet channel 11 may be secured to a forwardmost cabinet wall 18 defining the drawer opening as by an attachment screw 19. Stop flange 20 rests against the inner surface of the wall 18.

The bracket 14, which may be formed of nylon or like polymeric material, includes a horizontally directed plug 21 which extends into the body of the cabinet channel 11. A set screw, e.g. 22, threaded into a vertically directed aperture 23 in the plug 21 may be actuated to clamp the web portion 24 of the cabinet channel against a support ledge portion 25 of the bracket, securely to position the rear end of the cabinet channel. Preferably the plug 21 is of smaller transverse cross sectional dimension than the upstanding legs 26, 26 of the generally U-shaped cabinet channel so as to permit a degree of lateral adjustability of the rear end of the channel relative to the bracket, the set screw 22 locking the parts in a desired orientation when the adjustment has been effected.

It is to be noted that although the forward end of the cabinet channel is mounted to the front wall 18 as by a wood screw 19 driven into the end grain of the wall, since there are substantially no stresses exerted which might tend to unseat the forward end of the channel 11 from the cabinet, an end grain connection is adequate.

A principal advance of the present invention resides in the manner in which the drawer member D is connected to the drawer channel 12 since such connection provides substantially greater difficulties, due to the constant movements to which the drawer is subjected.

The drawer D includes a front panel 27 and a rear panel 28 connected by side panels 29, 30. The noted panels 27 to 30, as is typical, are provided with a peripheral groove 31 within which is contained the margins of the thin fiber or wood drawer bottom 32.

Figure 3:
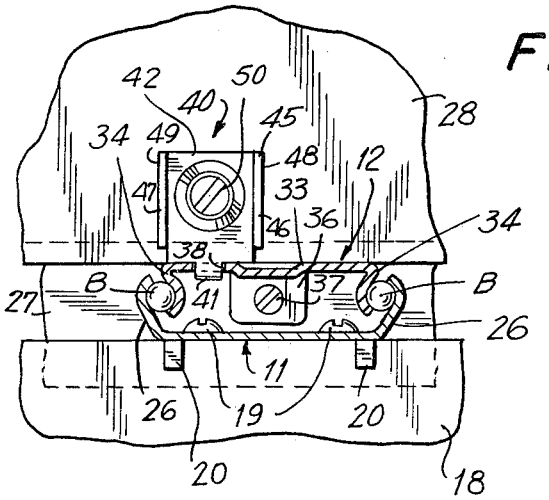
FIG. 3 is a fragmentary vertical section taken on the line 3—3 of FIG. 2.

The drawer channel 12, which is generally in the shape of an inverted U, includes a base or web portion 33 and depending legs 34, 34. As best seen from FIG. 3 and as is conventional, a series of balls B normally carried in a retainer is entrapped between the complemental legs 26, 34 of the respective channels 11 and 12 to facilitate the longitudinal relative telescoping movement between the channels.

The forward end 35 of the drawer channel 12 may include a depending fixed mounting flange 36 adapted to abut against the rear surface of the front panel 27 of the drawer and to be secured thereto as by wood screw 37.

Connection of the drawer channel to the rear panel 28 is effected by a mounting assembly next to be described and forming a principal advance of the present invention.

It will be readily recognized that if the distance between the rear surface of the panels 27 and 28 were fixed within minimal tolerances, it would be possible merely to provide an upstanding flange similar to flange 36 adjacent the rear end of the drawer slide and run a wood screw through the flange into the cross grain of the rear panel, whereby the channel 12 would be securely connected to the drawer. However, by virtue of the variability inherent in the fabrication of wooden drawers and, further, since it is highly desirable to provide a single stock slide assembly adaptable for use with drawers of a variety of depths, it is of especial advantage to fabricate a slide assembly which may be depthwisely adjusted for use with drawers whose depths fall within a wide range. Heretofore this result has been achieved by merely providing a multiplicity of closely spaced holes in the web of the drawer channel and running a wood screw through that hole which is most closely aligned with the centerline of the rear panel.

As previously noted, however, such construction is undesirable in that it necessitates an end grain anchoring of the screw, which anchorage, in the case of the drawer member, rapidly weakens with use. Moreover, if the selected aperture for reception of the screw is displaced significantly to one or the other side of the centerline, there is the possibility that application of the screw will crack the rear panel.

In accordance with the invention thereof and to effect the connection at the rear end of the drawer channel, the channel is provided with a multiplicity of through-going mounting apertures 38. The apertures are longitudinally offset from each other by selected increments, e.g. ¼" intervals. Preferably but not necessarily, in order not to compromise the rigidity of the channel, alternate apertures 38 may be disposed to opposite sides of the longitudinal centerline of the drawer channel. The channel, adjacent the respective apertures 38, may be marked with depth indicating indicia, e.g. 39.

A mounting bracket 40 is provided for effecting connection between the channel 12 and the rear panel 28 of the drawer. The mounting bracket, which is generally L-shaped in vertical section, includes an attachment finger 41 and an upstanding leg portion 42. The included angle between the finger 41 and leg 42 is just under 90°, i.e. in the area of 85°.

Leg portion 42 includes a through-going attachment aperture 43. The leg 42 includes a front attachment surface 44 and a rear attachment surface 45. The rear attachment surface 45 is defined by the end portions 46, 47 of a pair of vertically directed stop abutments 48, 49.

Figure 4:
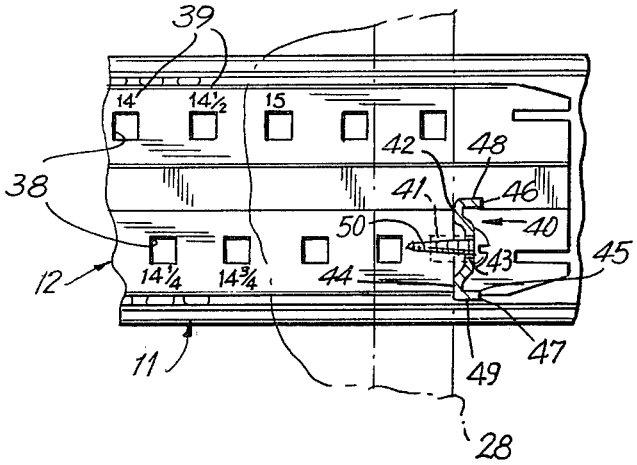
FIG. 4 is a fragmentary horizontal section taken on the line 4—4 of FIG. 2.
Figure 5:
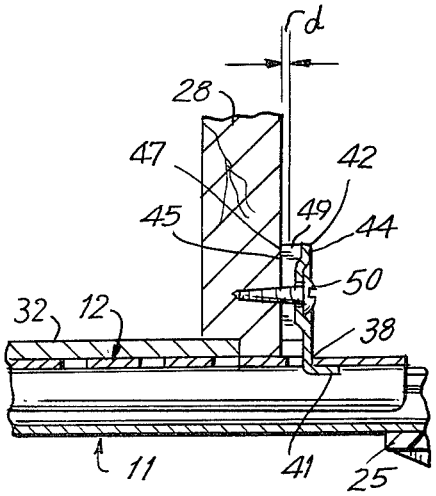
FIG. 5 is a fragmentary section similar to that of FIG. 2 showing the device mounted to a drawer which is slightly shorter in depth than the drawer of the other figures.

As will be seen by comparing FIGS. 4 and 5, the mounting bracket 40 may be inserted into any selected mounting aperture 38 in either of two positions, namely, in the position of FIG. 4 wherein the attachment surface 44 is nearest to and faces the flange 36, or the position shown in FIG. 5 wherein the rear attachment surface 45 defined by portions 46, 47 face toward the said flange. The spacing or offset in the horizontal plane of the forward and rearward attachment surfaces 44, 45 is coordinated with the longitudinal displacement of adjacent mounting apertures and the longitudinal extent of such apertures in such manner that a virtually infinite relative spacing may be achieved between the flange 36 and the selected position of the mounting bracket.

Referring to FIGS. 4 and 5 by way of example, the mounting bracket 40, if inserted in the rearmost aperture 38 and with finger 41 directed toward the flange 36, will have the forward attachment surface 44 spaced a preselected longitudinal distance from the flange. This condition is shown in FIG. 4.

If, however, the attachment face 44 in such position is spaced a significant distance rearwardly of the rearmost surface of rear panel 28, it is merely necessary to reinsert the mounting bracket in the position shown in FIG. 5, whereby the attachment surface 45 is nearest the flange 36. By virtue of the longitudinal extent of the stop abutments 48, 49 it will be perceived that when the bracket is mounted as shown in FIG. 5, the mounting surface 45 is closer to the flange 36 by a distance d.

An additional degree of adjustability is achieved by the fact that the mounting bracket need not be in an extreme longitudinal limiting position within the apertures 38. After the connection is effected to the rear panel, the bracket may lie in an intermediate position within the aperture 38, displaced from the forward and rearward ends of the apertures by a distance d without loss of rigidity since portions of the finger 41 will still underlie the channel in such intermediate positions.

Attachment of the mounting bracket 40 to the rear panel 28 of the drawer is effected by a horizontally directed screw 50 driven in the cross grain of the panel 28.

Further, in the preferred embodiment wherein the included angle between leg 42 and finger 41 is slightly less than 90°, a clamping action is achieved between the finger 41 and undersurface of web portion 33 of the drawer channel. This clamping action results from the tightening of the attachment screw 50 which tends to conform the bracket to the right angular relation existing between the wall 28 of the drawer and the web 33.

From the foregoing it will be perceived that there is provided a bottom mounted drawer slide assembly wherein a secure connection between the drawer slide and the drawer may be effected to drawers of any of a wide range of depths. The connection does not require the attachment screw to be driven into the end grain of the rear panel but, rather, permits the more secure cross grain connection.

By providing a mounting bracket insertible into any of a series of longitudinally spaced mounting apertures, a high degree of depthwise adaptability is permitted. Moreover, by providing longitudinally offset forward and rearward surfaces on the bracket and enabling the bracket to be secured to the channel with either of the two said surfaces nearest the front panel of the drawer, the versatility of the device is further increased.

By providing a structure in which the mounting bracket is permitted a limited degree of movement even within the mounting apertures, an infinite variety of drawer depths within a given range may be accommodated. Thus, even if the tolerances of a given batch of drawers should vary, a secure connection of drawer to channel is assured, particularly in the light of the clamping action aforesaid.

As will be obvious to those skilled in the art and apprised of the instant disclosure, numerous variations in detail of the illustrated embodiment may be made without departing from the spirit of the invention. Accordingly, the invention is to be broadly construed within the scope of the appended claims.

Having thus described the invention and illustrated its use, what is claimed as new and is desired to be secured by Letters Patent is:

1. A bottom mounted drawer slide assembly comprising, in combination, a fixed channel member adapted to be mounted to a cabinet, said fixed channel member being U-shaped in vertical section, a drawer channel generally U-shaped in vertical section and including a horizontally disposed central web, antifriction means interposed between said channels and coupling the same for longitudinal movement between telescoped and extended relative positions, a fixed mounting flange adjacent a forward end of said drawer channel, said flange being formed from and disposed in a plane normal to said web, said flange being adapted to be secured to the front panel portion of a drawer by a horizontally directed fastener member, a plurality of mutually longitudinally spaced mounting apertures formed in said web adjacent the rear end thereof, a mounting bracket adapted to be seated selectively in one of said apertures in accordance with the depth of said drawer, said bracket including a channel attachment finger adapted to extend through a said aperture and engage against under portions of said web surrounding said aperture, said bracket having a drawer attachment disposed substantially at a right angle to said finger said leg including a fastener aperture adapted to receive a horizontal fastener member extending therethrough and into the rear panel of said drawer, thereby to couple said panel to said leg and said bracket to said web.

2. A drawer slide assembly in accordance with claim 1 wherein the included angle between said leg and said finger is under 90° whereby a clamping action between said finger and the under surface of said web is achieved when said leg is drawn against said rear panel by said fastener member.

3. A bottom mounted drawer slide assembly comprising, in combination, a fixed channel member adapted to be mounted to a cabinet, said fixed channel member being U-shaped in vertical section, a drawer channel generally U-shaped in vertical section and including a horizontally disposed central web, antifriction means interposed between said channels and coupling the same for longitudinal movement between telescoped and extended relative positions, a fixed mounting flange adjacent a forward end of said drawer channel, said flange being formed from and disposed in a plane normal to said web, said flange being adapted to be secured to the front panel portion of a drawer by a horizontally directed fastener member, a plurality of mutually longitudinally spaced mounting apertures formed in said web adjacent the rear end thereof, a mounting bracket adapted to be seated selectively in one of said apertures in accordance with the depth of said drawer, said bracket including a channel attachment finger adapted to extend through a said aperture and engage against under portions of said web surrounding said aperture, said bracket having a drawer attachment leg disposed substantially at a right angle to said finger, said leg including a fastener aperture adapted to receive a horizontal fastener member extending therethrough and into the rear panel of said drawer, thereby to couple said panel to said leg and said bracket to said web, said bracket further including a forward attachment surface and a rearward attachment surface, said finger being insertible into said mounting apertures in one of two selected positions, namely with said forward or said rearward attachment surface nearest to said fixed flange, the longitudinal displacement of said flange from said attachment surfaces being a first value when said forward attachment surface is nearest said flange, and a different value when said rearward said attachment surface is nearest said flange.

4. A drawer slide in accordance with claim 3 wherein said forward attachment surface is in substantial coplanar alignment with the junction of said finger and said leg, and said rearward attachment surface is parallel to and displaced from said plane.

5. A drawer slide assembly in accordance with claim 4 wherein the spacial displacement of said forward and rearward attachment surfaces is a value different from the longitudinal displacement of the walls defining said mounting apertures, whereby the distance between said flange and the attachment surface of said bracket nearest said flange may be adjusted by increments smaller than the spacing of said apertures in accordance with the attachment surface nearest said flange.

6. A drawer slide assembly in accordance with claim 5 wherein alternate said mounting apertures are laterally displaced to opposite sides of the longitudinal centerline of said web.

7. A drawer slide assembly in accordance with claim 3 wherein the included angle between said leg and said finger is under 90° whereby a clamping action between said finger and the under surface of said web is achieved when said leg is drawn against said rear panel by said fastener member.

* * * * *